US005393196A

United States Patent [19]

Bluemle

[11] Patent Number: 5,393,196

[45] Date of Patent: Feb. 28, 1995

[54] METHOD AND APPARATUS FOR STACKING OF ENVELOPES OR THE LIKE

[75] Inventor: Martin Bluemle, Horhausen, Germany

[73] Assignee: Winkler & Duennebier Maschinenfabrik und Eisengiesserei KG, Neuwied, Germany

[21] Appl. No.: 978,684

[22] PCT Filed: May 19, 1992

[86] PCT No.: PCT/EP92/01097

§ 371 Date: Jan. 19, 1993

§ 102(e) Date: Jan. 19, 1993

[87] PCT Pub. No.: WO92/21599

PCT Pub. Date: Dec. 10, 1992

[30] Foreign Application Priority Data

May 28, 1991 [DE] Germany ..... 4117434

[51] Int. Cl.[6] ..... B65H 31/06

[52] U.S. Cl. ..... 414/790.2; 198/740; 271/181; 414/786

[58] Field of Search ..... 198/740, 741; 271/181, 271/215; 414/790.2, 798.5, 786

[56] References Cited

U.S. PATENT DOCUMENTS

| | | | |
|---|---|---|---|
| 3,810,344 | 5/1974 | Evans et al. | 414/798.5 X |
| 3,866,905 | 2/1975 | Trogan et al. | 271/181 |
| 4,772,003 | 9/1988 | Nobuta et al. | 271/181 X |
| 4,870,803 | 10/1989 | Bluemle | 53/447 |

FOREIGN PATENT DOCUMENTS

| | | | |
|---|---|---|---|
| 111432 | 6/1984 | European Pat. Off. | 414/790.2 |
| 0384255 | 8/1990 | European Pat. Off. . | |
| 1182252 | 11/1964 | Germany . | |
| 2033326 | 2/1971 | Germany . | |
| 3820523 | 11/1989 | Germany . | |
| 3822103 | 2/1990 | Germany . | |
| 59-36066 | 2/1984 | Japan | 271/181 |
| 607979 | 12/1978 | Switzerland . | |

*Primary Examiner*—Michael S. Huppert
*Assistant Examiner*—Janice L. Krizek
*Attorney, Agent, or Firm*—W. G. Fasse; W. F. Fasse

[57] ABSTRACT

Articles, such as envelopes, are formed into stacks that are transported to a packing station. For this purpose a stacking and transport mechanism is positioned between a depositing mechanism (4, 4*a*) and the packing station. Continuously and individually arriving articles are set with one of their edges (6, 6*a*) on a stacking surface (7, 7*a*). The articles to be stacked are first held at the beginning of the formation of a stack (10, 10*a*), by a first, forward or leading stack holder (8, 8*a*) which moves in the direction in which the stack (10, 10*a*) increases, (FIG. 4 ) toward the packing station. Thereafter, a second forward or leading stack holder (9, 9*a*) takes the position of the first, forward stack holder (8, 8*a*) (FIG. 6 ). Upon completion of the stack (10, 11 or 10*a*, 11*a*) (FIG. 2 ) a third, forward or leading stack holder (12, 12*a*) and a rear stack holder (13, 13*a*) take over the stack (11, 11*a*) to transport it to the packing station, whereby simultaneously with the take-over of the stack (11, 11*a*) by the third forward stack holder (12, 12*a*) and by the rear stack holder (13, 13*a*), the first forward stack holder (8, 8*a*) together with the rear stack holder (13, 13*a*) operate for separating the completed stack (11, 11*a*) from the next stack being formed.

10 Claims, 14 Drawing Sheets

METHOD AND APPARATUS FOR STACKING OF ENVELOPES OR THE LIKE

FIELD OF THE INVENTION

The invention relates to a method and to an apparatus for stacking that is, for forming, holding, separating, and transporting of stacks, especially stacks made up of letter envelopes or the like downstream of a depositing mechanism which deposits continuously and individually arriving letter envelopes with one envelope edge on a stacking surface.

BACKGROUND INFORMATION

A method and an apparatus of the type mentioned are known. The apparatus has a forward stack holder and a rear stack holder, whereby the forward stack holder functions as a holding element during the stack formation while the rear stack holder separates the completed stack from the next stack. The rear stack forms together with the forward stack a transport unit. This known apparatus functions basically in a satisfactory manner.

SUMMARY OF THE INVENTION

The invention aims at solving the problem of further improving this technology and to make it more efficient, specifically to assure a positive control of stacks being formed and of an already formed stack. For this purpose the invention provides that during the removing transport of one stack and the simultaneous formation of the next new stack, simultaneously several stack holders are operational and are being moved into the movement path of the stack and out of the movement path as well as alongside the movement path.

Contrary to the prior art, the invention provides not only two stack holders that simultaneously function as transport unit, rather, the invention provides further movable stack holders. These further stack holders are, just as the stack holders serving as a transport unit, movable into the motion or movement path of the stack and out of the stack movement path as well as alongside the movement path of the stack. The movement of stack holders along the movement path is limited only to the area of the stack formation. The stack holders that are only movable in the area of the stack formation are further effective until their function is taken over by the two other stack holders that serve simultaneously as a transport unit.

According to one example embodiment, three stack holders are moved from one side across the movement path and alongside the movement path of the stack while a fourth stack holder is moved from a second side into the movement path and out of the movement path as well as temporarily along the movement path during the stack formation. Due to this combination of moving stack holders, the motion of the three stack holders takes place preferably from below upwardly as well as back and in the longitudinal direction of the motion path, while the motion of the single stack holder takes place from above downwardly and back as well as in the direction of the motion path of the stacks.

Since the stack holders become effective partially simultaneously and partially in alternation, and since they supplement each other in positively controlling the stacks, a continuous motion sequence is possible without interruption, whereby the stack formation also takes place continuously and with an altogether small individual velocity of the individual components. As a result, a high degree of operational reliability and hence a small susceptibility to trouble.

BRIEF DESCRIPTION OF THE DRAWINGS

The invention will now be described in more detail in the following with reference to example embodiments shown in the accompanying drawing, wherein.

DETAILED DESCRIPTION OF PREFERRED EXAMPLE EMBODIMENTS AND OF THE BEST MODE OF THE INVENTION

Figure 5:
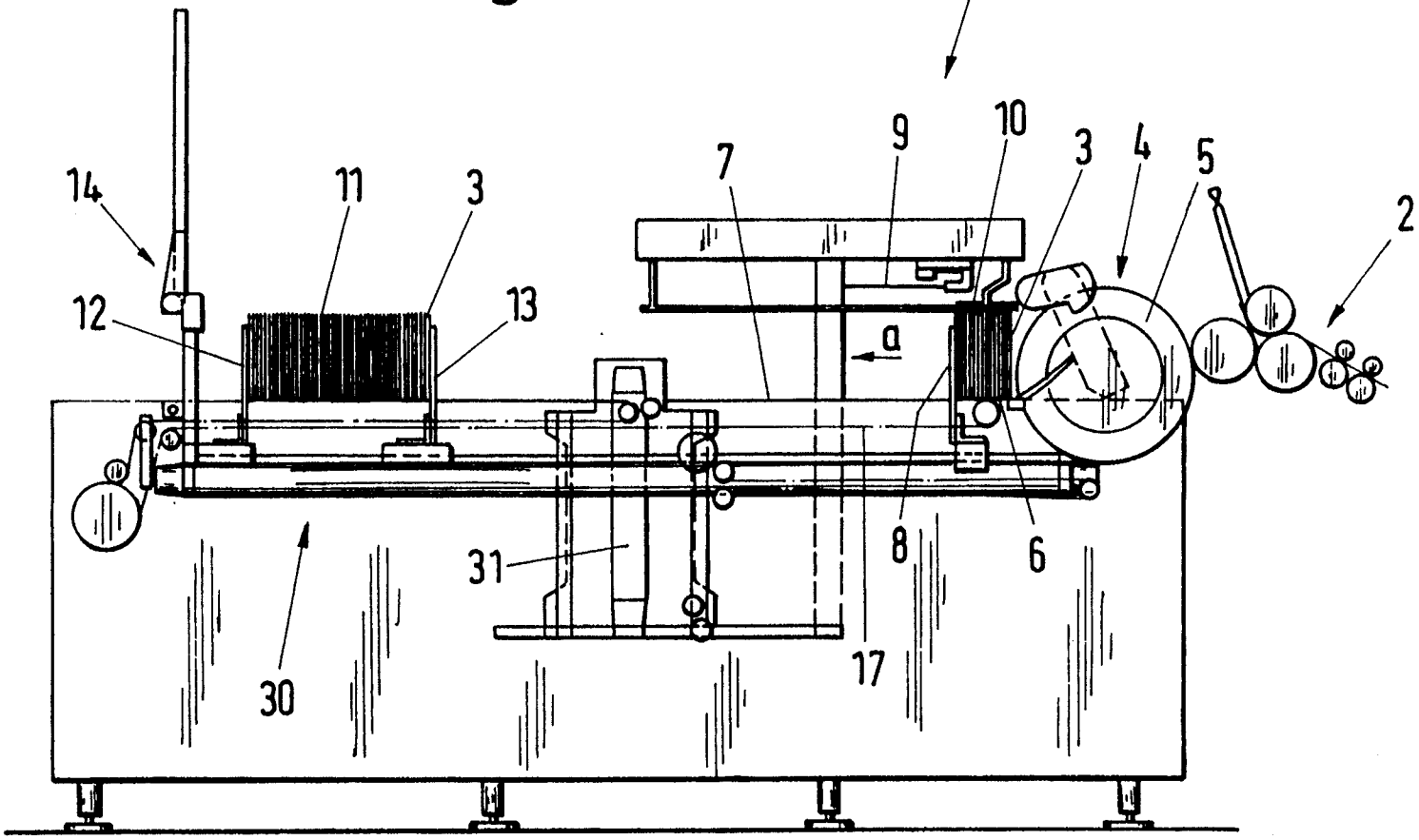
FIG. 5 is a view as in FIGS. 1 to 4, showing the finished stack completely transported away and the further stack still in its state of being formed, whereby the stack is only held by its first forward stack holder.

A stacking machine 1 for stacking of letter envelopes 3 coming, for example, from a feeding station 2, comprises according to FIG. 5 a depositing mechanism 4 having compartment disks 5. The feeding station 2 and the depositing mechanism 4 are basically known and not part of the invention.

As further shown in FIG. 5, the continuously and individually arriving letter envelopes 3 are deposited with one of their edges 6 by the depositing mechanism 4 on a stacking surface 7 of the stacking machine 1, where, the envelopes are held initially by a first forward stack holder 8. The term "forward" stack holder 8 means that this stack holder 8 is located forward in the direction of the stack formation, that is in the direction of the arrow a in FIG. 5.

Figure 6:
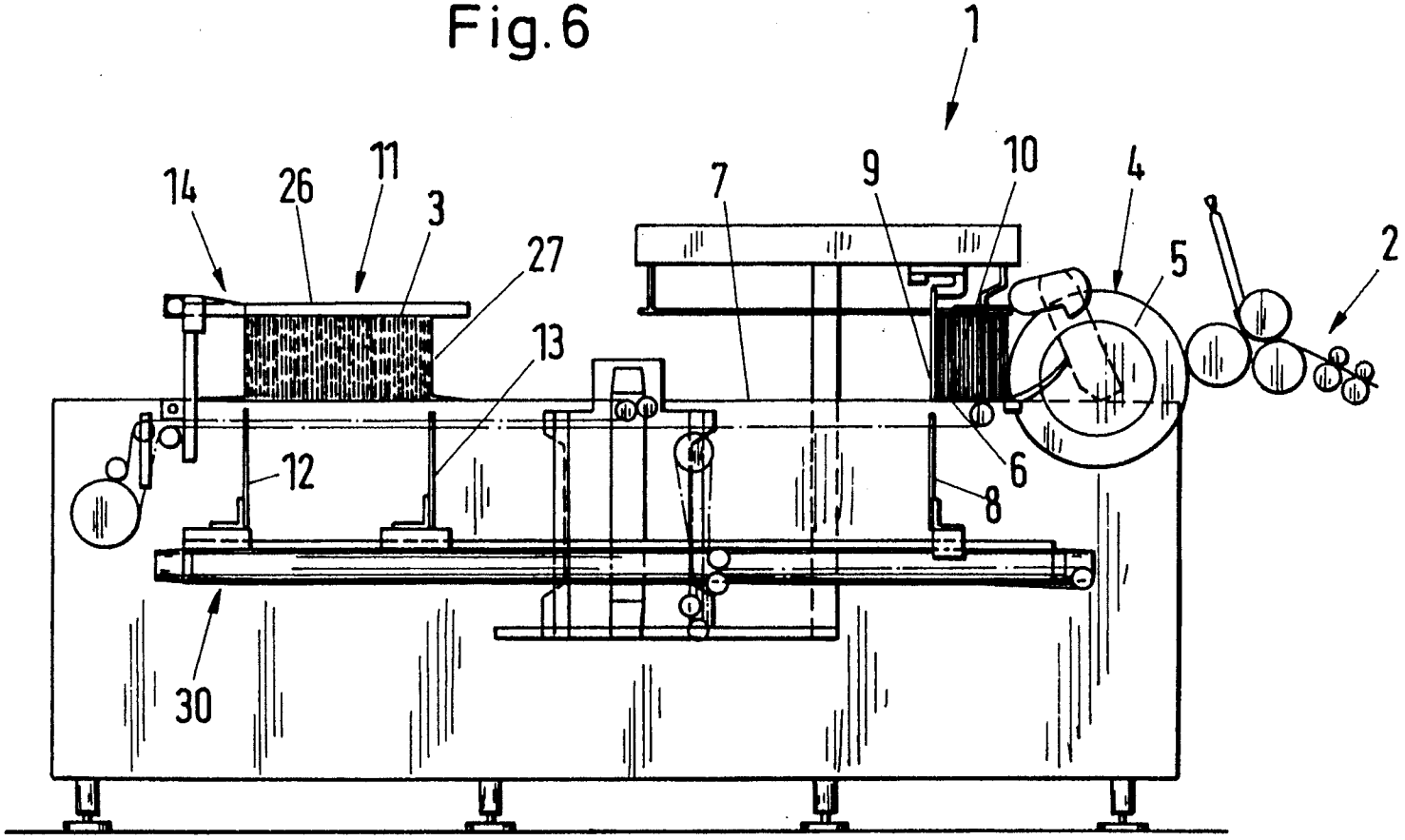
FIG. 6 is a view similar to FIG. 5 showing the stack being formed, held by the second forward stack holder.

As soon as the stack 10 has reached a predetermined size (FIG. 6), a second forward stack holder 9 takes up the position of the first forward stack holder 8 and holds the stack being formed so that the first forward stack holder 8 can be moved out of the movement path of the stack 10 being formed. This is also shown in FIG. 6.

Figure 2:
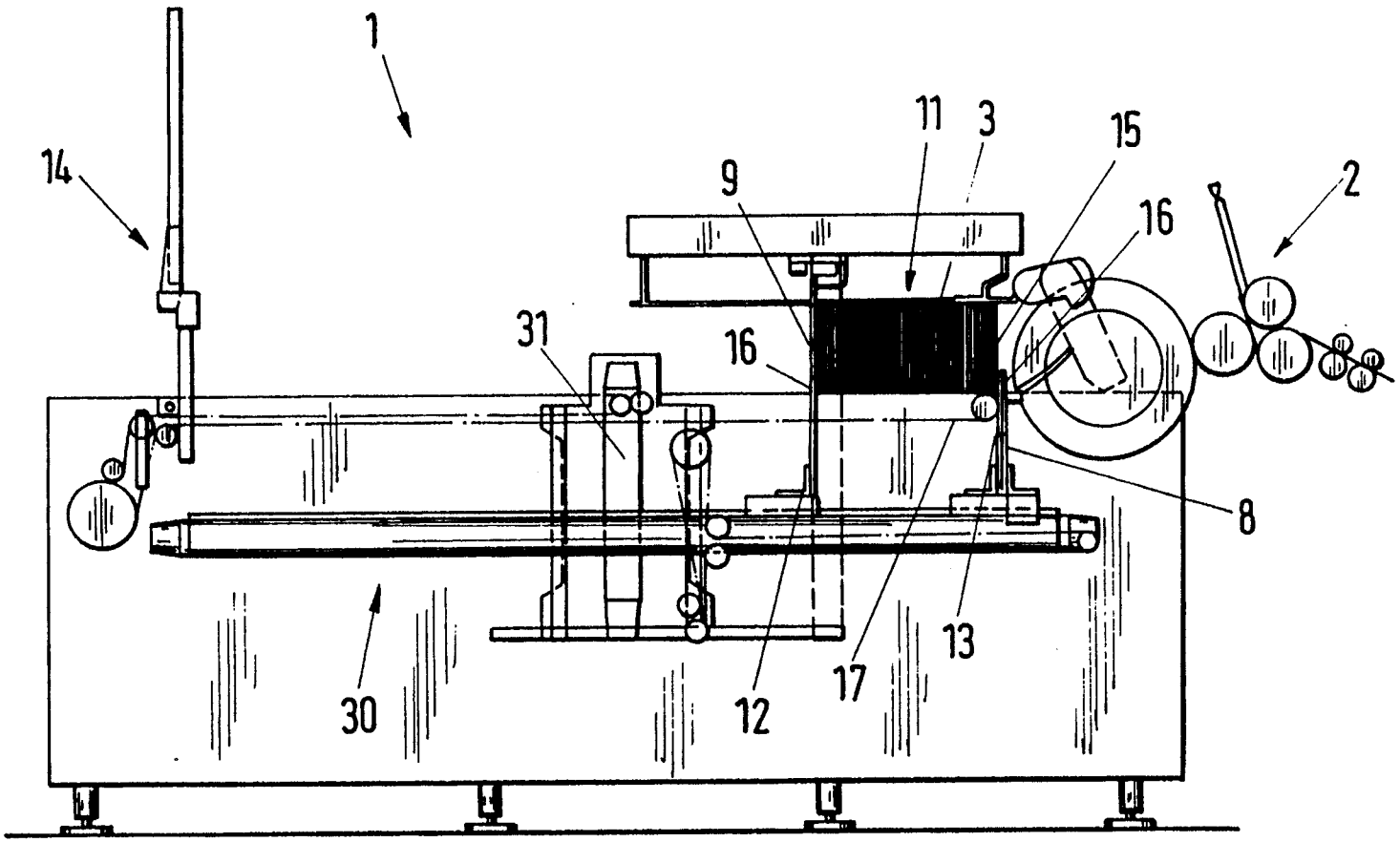
FIG. 2 is a view as in FIG. 1 but with a completed stack and with stack holders forming a transport unit in a position prior to taking over the completed stack.

When, finally, the stack 10 being formed has become a complete stack 11 according to FIG. 2, the third forward stack holder 12 and a rear stack holder 13, as viewed in the transport direction, take over the stack 11. The two stack holders 12 and 13 form together a transport unit and transport the completed stack 11 out of the zone of the stack formation, for example, to a turnover and packaging station 14 as is shown in FIGS. 2 to 5 or 6.

Figure 3:
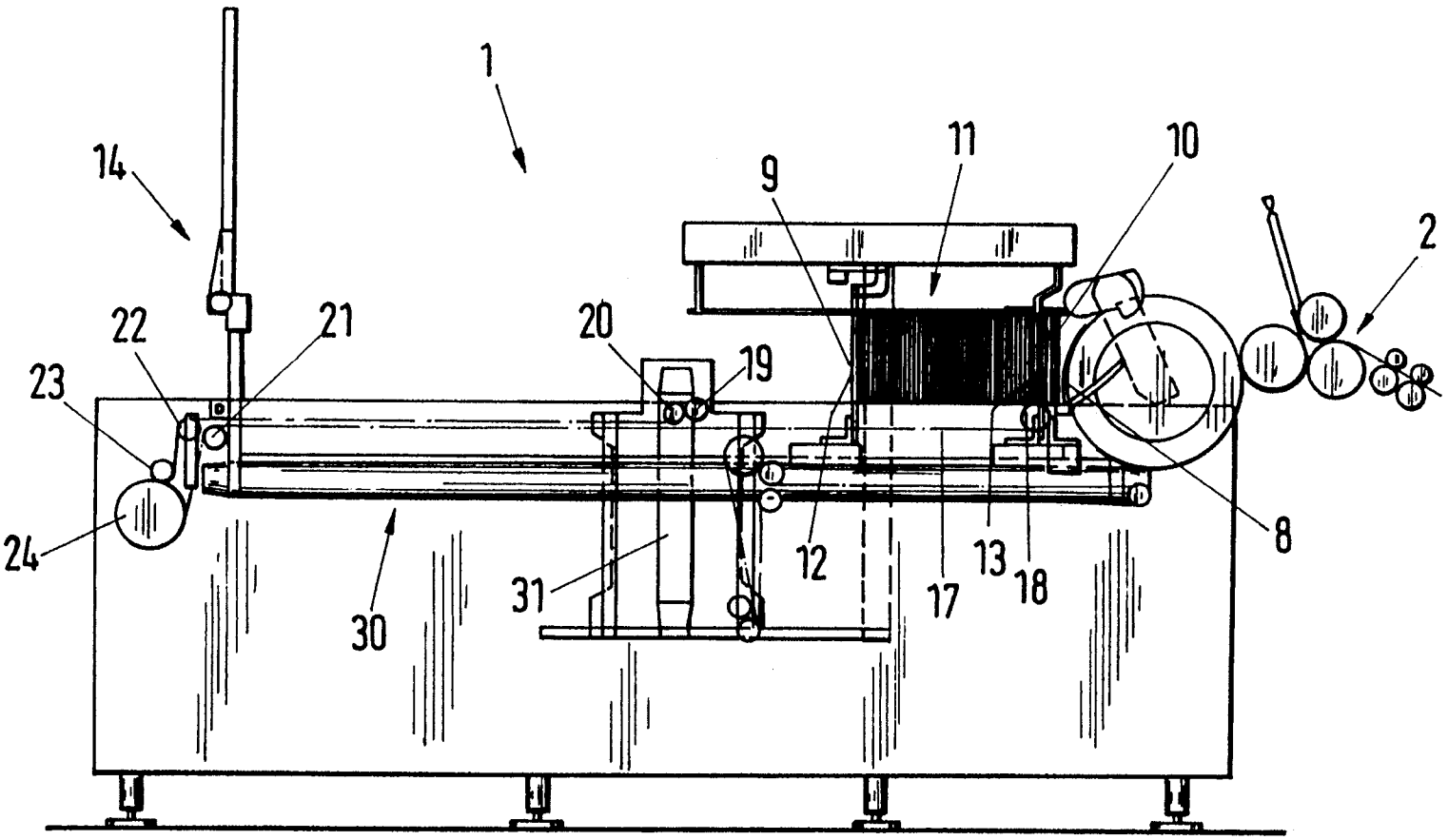
FIG. 3 is a view as in FIG. 2, showing the stack holders forming the transport unit after they have taken over the completed stack.

When the two stack holders 12 and 13 serving as a transport unit take over the stack 11, the first forward stack holder 8 is simultaneously moved in front of the next part to be stacked. Thus, the first forward stack holder 8 serves simultaneously as a separation element between a finished, completed stack 11 and the next stack 10 being formed (FIGS. 2 and 3).

For the forming, holding, separating, and transporting of stacks 10, 11 there are thus several, more specifically four stack holders 8, 9 and 12, 13 for positively controlling the stacks. These holders move into the motion path of the stacks 10, 11 and out of the motion path of the stacks. Additionally, the holders move alongside the motion path of the stacks 10, 11. Three stack holders 8, 12, and 13 move from one side across the motion path of the stacks 10, 11, and alongside of the motion path, whereas the fourth stack holder 9 moves from a second side into the motion path and out of the motion path again. At certain times during the stack formation the fourth holder 9 also moves alongside the motion path.

According to the example embodiment shown in FIGS. 1 to 7, the second forward stack holder 9 is tilted from above in front of a stack being formed, and moves during the stack formation along the motion path of the stack 10 until the stack holder is tilted again upwardly and then moves backward in the direction of the depositing mechanism.

The individual figures show the different process steps as follows.

Figure 1:
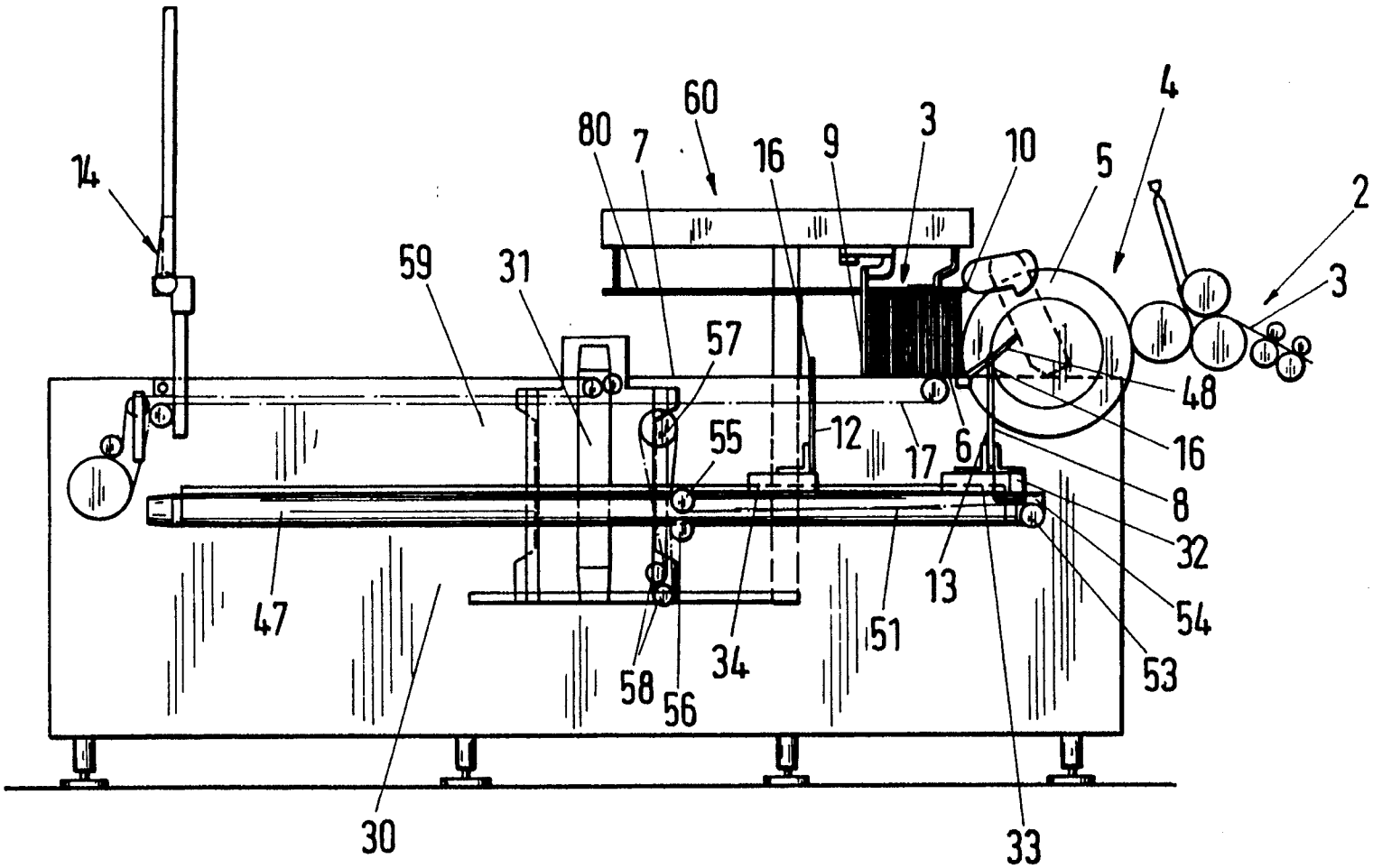
FIG. 1 is a schematic side view of the present apparatus for stacking showing a partially completed stack.

According to FIG. 1, the second forward stack holder 9 holds the stack 10 being formed while the stack holders 12 and 13 serving as a transport unit are in a ready position. At this time the first forward stack holder 8 is also in its ready position. In this ready position, the stack holders 8 and 13 are located with a slight spacing in front of the stack 10 on its side facing the depositing mechanism 4 and extend with their free ends 16 slightly above the stack surface 7.

In FIG. 2, the stack 11 has reached its full size. The second forward stack holder 9 and the third forward stack holder 12 that forms part of the transport unit, are positioned in one plane. The rear stack holder 13 and the immediately next to it located first forward stack holder 8 have moved out of the ready position of FIG. 1 into contact with the last member 15 of the complete stack 11. This operation takes place on a relatively low level so that initially, the forward stack holder 12, as well as the rear stack holder 13, rest against the outside of the stack 11 only with their upper edges 16.

As shown in FIG. 3, then the two stack holders 12 and 13 move along the stack upwardly and simultaneously somewhat in the movement direction of the stack 11 to be transported away.

The stack 10 or 11 rests in the stack formation area suitably on the upper run of a conveyor belt 17 running around guide rollers 18 to 23 and around one driving and guide roller 24.

Figure 4:
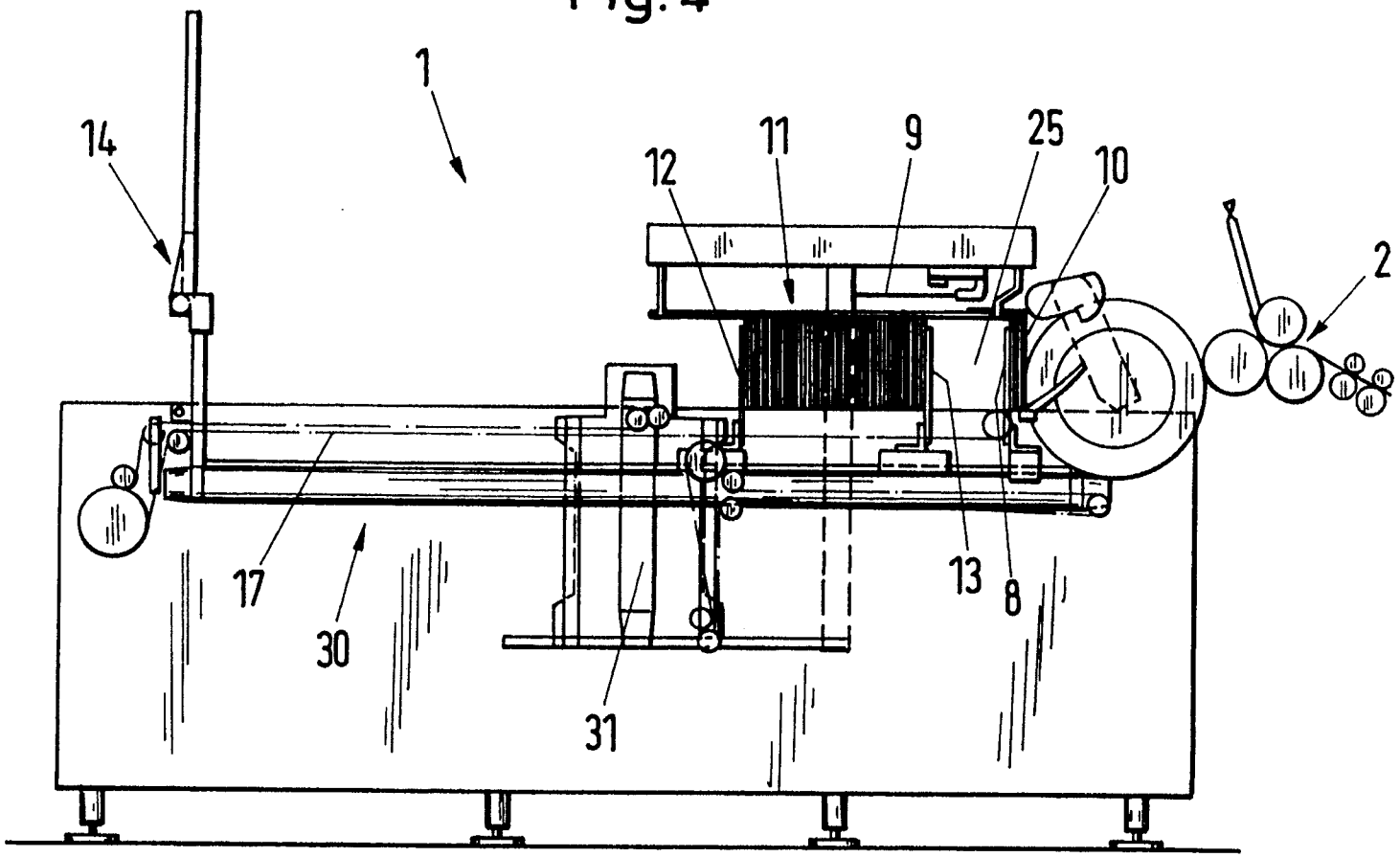
FIG. 4 is a view as in FIGS. 1 to 3, with a completed stack being transported away and with a further stack being formed anew.

The transport speed of the two stack holders 12 and 13 forming the transport unit is larger than the transport speed of the conveyor belt 17 so that quickly a gap 25 is formed relative to the next stack 10 being formed (FIG. 4). This next stack 10 being formed is held by the first forward stack holder 8 which has been moved together with the rear stack holder 13 out of the ready position according to FIG. 1 after completion of the stack 10 according to FIG. 2, into contact with the last member 15 of the stack, whereby this movement initially also takes place on a low level. Thereafter, the first forward stack holder 8 is moved crosswise to the stack direction out of the position of FIG. 2 into the support position of FIG. 3. Further, when the third forward stack holder 12 has reached its upper position of FIG. 3, the second forward stack holder 9 is moved out of the motion path of the stack 11. At this stage, the stack holder 9 tilts out of the motion path of the stack 11 (FIG. 4).

According to FIG. 5 the two transport stack holders 12 and 13 have reached with the stack 11 the turnover and packaging station 14. During this time, the stack 10 being formed has grown in size.

FIG. 6 shows the situation in which the turnover and packaging station 14 has taken over the stack 11 by its turnover fork 26. Further, a folding box has already been pushed over the stack 11. Thus, the stack holders 12 and 13 serving as a transport unit, can release themselves from the stack 11. For this purpose, they are pulled away from the stack. This takes place according to the example embodiment downwardly by lowering the two stack holders 12 and 13.

However, prior to the lowering of the holders 12, 13, the second forward stack holder 9 which is tiltable inwardly from above has taken over the securing of the stack being formed as shown by comparing of FIGS. 5 and 6. With the lowering of the two stack holders 12 and 13, the first forward stack holder 8 is also lowered according to the example embodiment so that it can no longer hold the stack being formed (FIG. 6).

Figure 7:
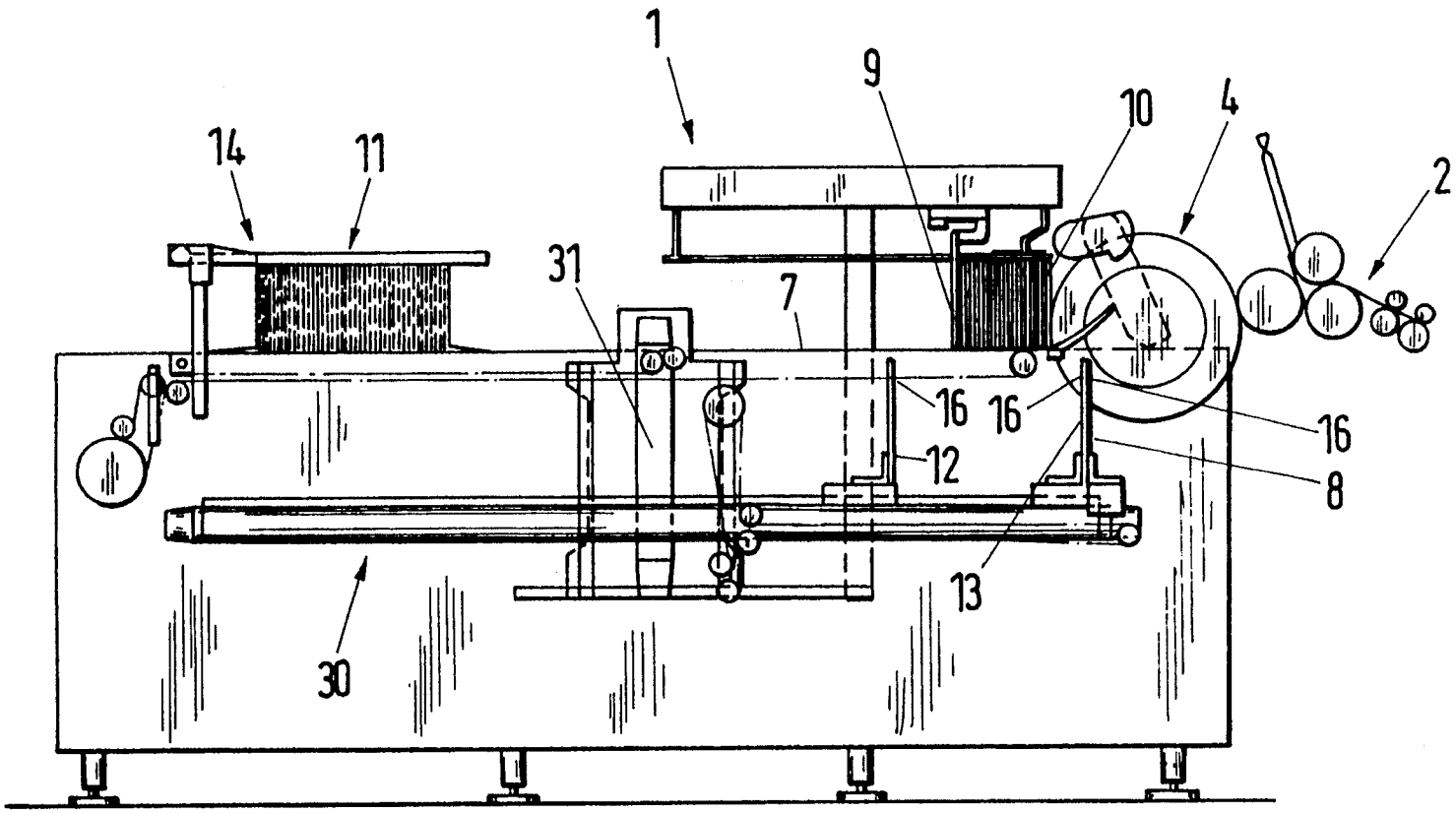
FIG. 7 is a view similar to FIG. 6, whereby the stack being formed is held by its second forward stack holder, while the other stack holders are in a withdrawn waiting position out of which they move into a ready position.

Thereafter, the three stack holders 8, 12, and 13 that are movable from the same side across the motion path of the stacks 10, 11 move from the position on the left side of FIG. 6 into a waiting position on the right side in FIG. 7. In this waiting position, the free end 16 of the stack holders 8, 12, and 13 are still below the stacking surface 7 at a level into which they are moved back after the lowering shown in FIG. 6 into a position according to FIG. 7. From this lowered level below the stacking surface 7, the stack holders 8, 12, and 13 are then lifted again into the ready position until they extend with their upper free end 16 somewhat above the level of the stacking surface 7 as is shown in FIG. 1. Thereafter, the above described process steps will be repeated.

A mechanism 30 serves for mounting and driving the first forward stack holder 8 and the stack holders 12 and 13 serving as a transport unit. The mechanism 30 can be lowered with the aid of a stroke device 31 shown only symbolically in the figures, said lowering taking place from the lifted position of FIG. 1 into the position of FIG. 6. The mechanism 30 comprises components for mounting and guiding, as well as driving the stack holders 8, 12, and 13.

The first forward stack holder 8 and the two stack holders 12 and 13 forming a transport unit are each arranged on a slide 32 or 33 and 34 (FIG. 1). The mechanism 30 according to the example embodiment comprises outwardly positioned guide rods 35 and 36 (FIG. 10) for mounting and guiding the slides 32 of the stack holder 8. The mechanism 30 further comprises inwardly located guide rods 37 and 38 for mounting and guiding the two other stack holders 12 and 13, whereby in FIG. 10 only the slide 33 with the stack holder 13 is shown, while the slide 34 with the stack holder 12 is not also shown. The pairs of guide rods 35, 36, as well as 37 and 38 are located preferably at different elevations as is seen in FIG. 11.

Figure 10:
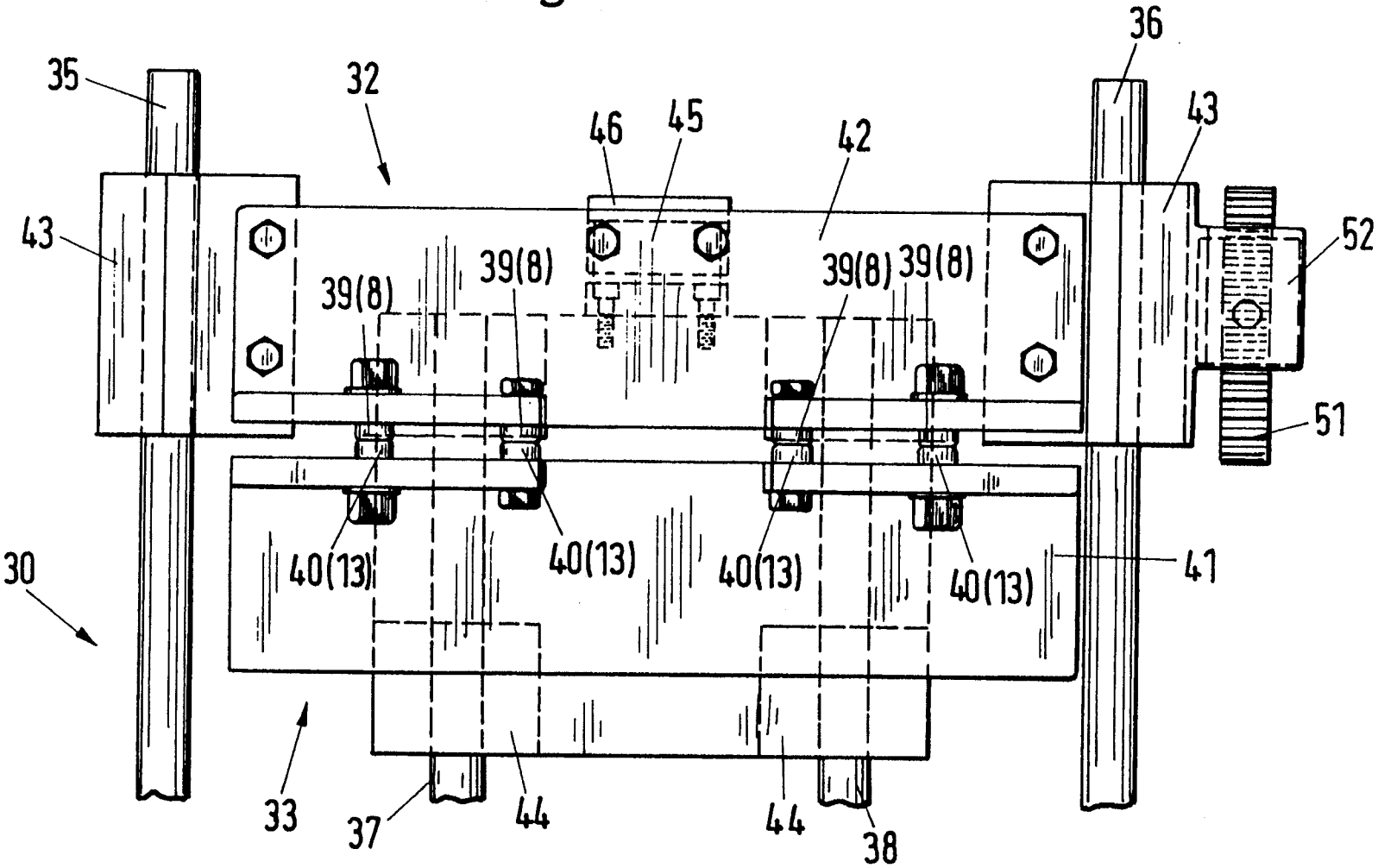
FIG. 10 is a plan view of the mounting of the first forward stack holder and of the rear stack holder.
Figure 11:
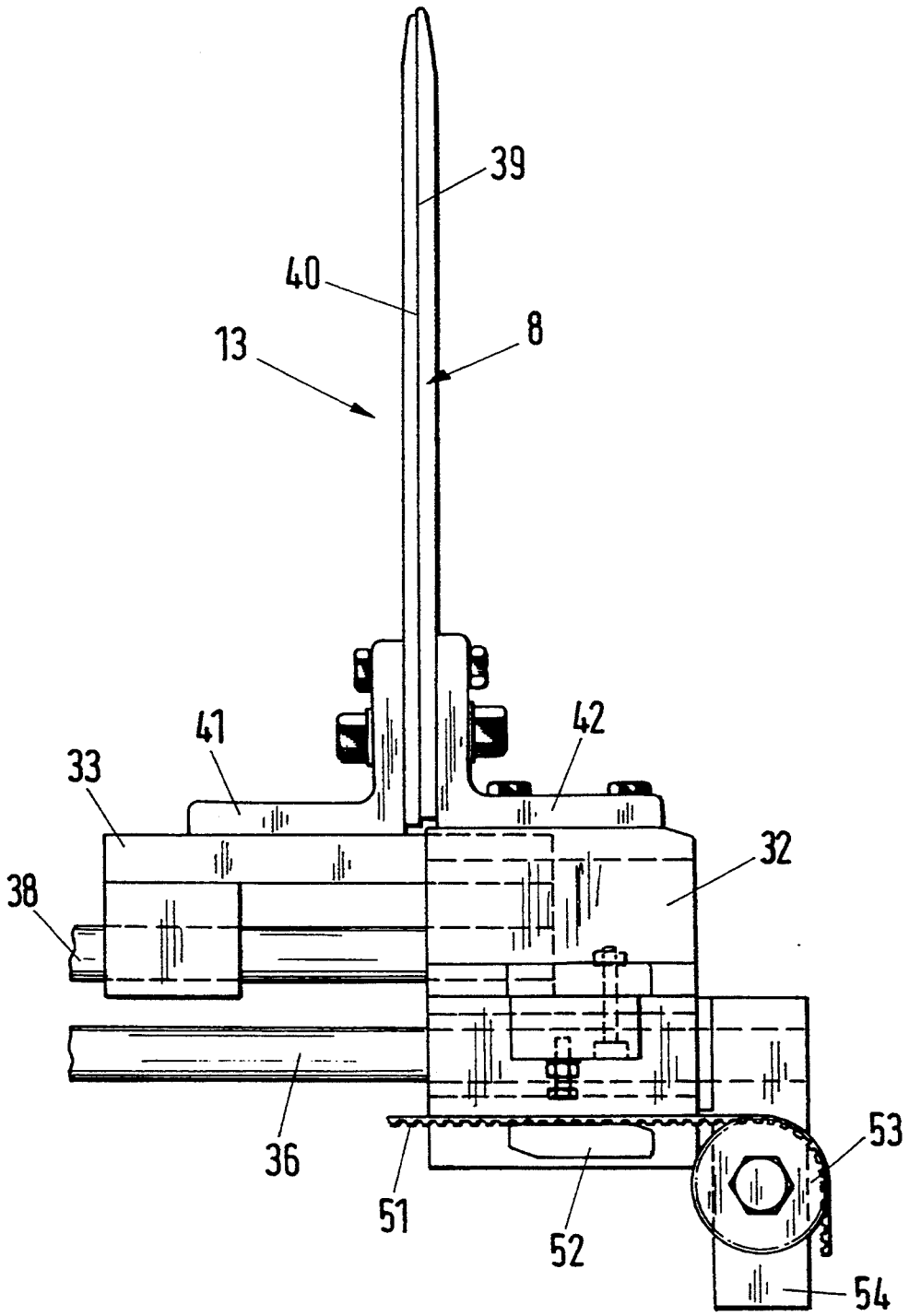
FIG. 11 is a side view of the first forward stack holder and of the rear stack holder.

The rear stack holder 13 and the first forward stack holder 8 which functions with the rear stack holder 13 as a separation element, comprise each, for example, four elongated finger type elements 39 or 40, which form in turn with the aid of angle irons 41 and 42, and guide bushings 43 or 44 the slides 32 and 33 according to FIGS. 10 and 11. The guide bushings 43 or 44 are mounted on guide rods 35 to 38 at the ends of the angle irons 41 and 42.

Figure 12:
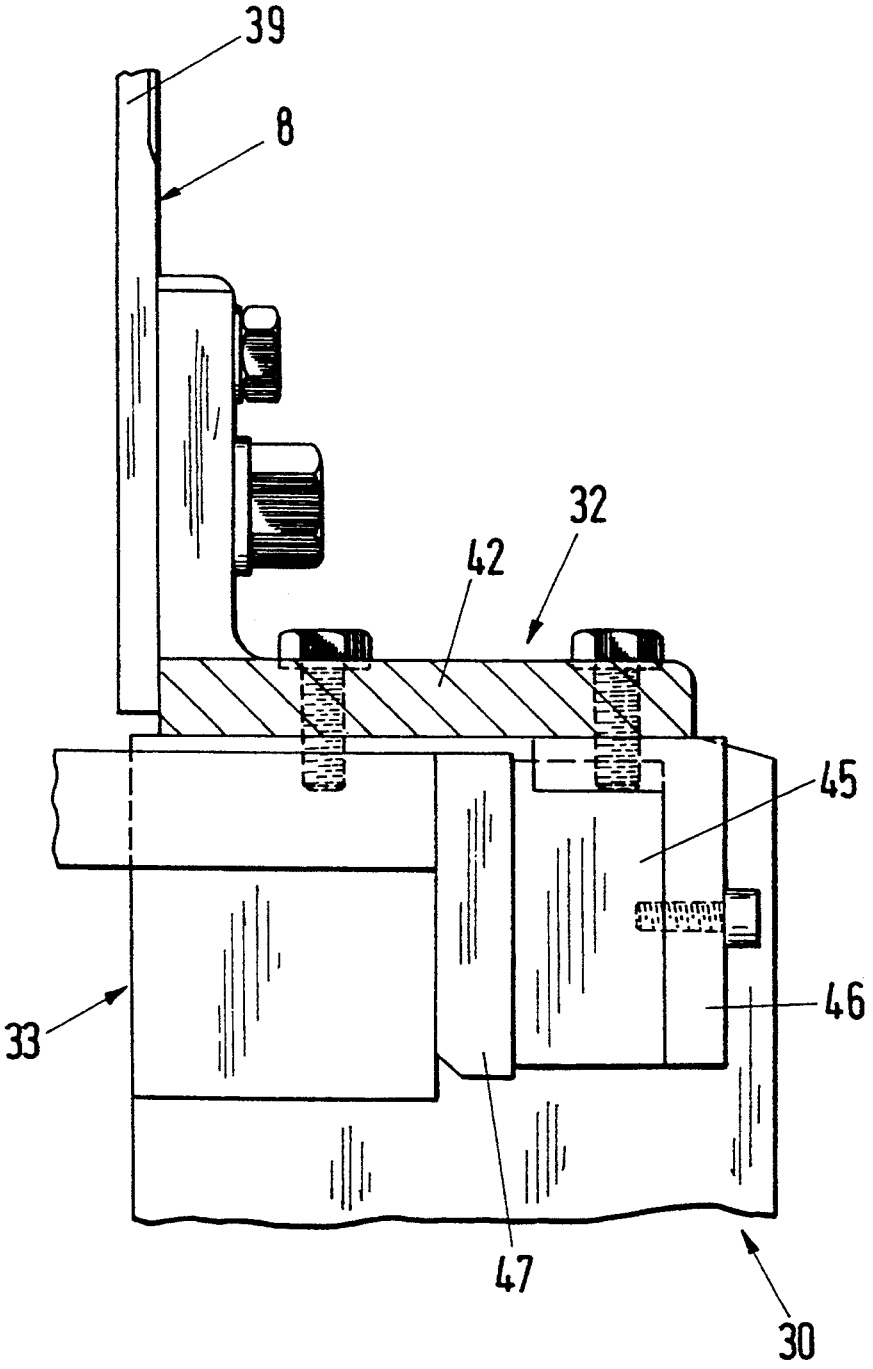
FIG. 12 shows, on a larger scale, details of the mounting of the first forward stack holder.

Further, an electromagnetic clutch 45 is secured to the slide 32 with the aid of a bracket 46 as shown symbolically in FIGS. 10 and 12. The slide 33 of the rear stack holder 13 carries a steel plate 47 (FIG. 12) provided for the electromagnetic clutch 45. The two slides 32 and 33 are thus temporarily connected to each other by the holding force of the electromagnetic clutch 45.

The connection of the two slides 32 and 33 and thus the synchroneous movement in unison of the rear stack holder 13 and of the first forward stack holder 8 which simultaneously forms therewith a separation element, is important when these stack holders 8 and 13 are moved very rapidly out of the ready position according to FIG. 1 into the separating position according to FIG. 2. Such movement is approximately instantaneous, whereby this movement must take place exactly between two parts to be stacked. Upon reaching the separation position according to FIG. 2, the two stack holders 8 and 13 still move in unison crosswise to the motion path of the stack 11. However, now a separation of the two stack holders 8 and 13 takes place. The stack holders 13 must only hold still the completed stack 11 during its transport to the turnover and packaging station 14, while the first forward stack holder 8 prevents falling over of the next envelopes deposited by the depositing mechanism 4.

The release of the two slides 32 and 33 within the operating range of their electromagnetic clutch 45 for separating the two stack holders 8 and 13 from each other, takes place with the aid of switches which are not shown in the Figures, and which may be controlled by the slides themselves.

The mechanism 30 further comprises a piston cylinder unit 47 which may, for example, be a cylinder without a piston rod, the piston of which, which is not shown in the Figures, moves the two stack holders 8 and 13 instantaneously out of the waiting position according to FIG. 1, into the separation position according to FIG. 2. The free ends 16 of the two stack holders 8 and 13 are located in the waiting position according to FIG. 1, already within the radius of the compartment disk 5 in the plane of the deposit support 48 of the depositing mechanism 4 as also shown in FIG. 1. Additionally, the mechanism 30 is slightly lifted by the stroke device 31.

The transport of the stack 11 out of the position of FIG. 2 or 3 all the way to the turning and packaging station 14 takes place with the aid of the piston cylinder device 47 which is connected with the rear stack holder 13 to displace the same.

The piston cylinder device 47 moves the rear stack holder 13 back again into the starting position or waiting position according to FIG. 7, whereby the slide 32 of the first front stack holder 8 is coupled with the slide 33 of the rear stack holder 13 with the aid of the electromagnetic clutch 45. The stack holder 12 belonging to the transport unit receives its drive for the rearward motion from a return spring which is not shown in the figures for clarity's sake.

A gear belt 51 (FIGS. 10 and 11) is provided for the slide 32 of the first forward stack holder 8. The gear belt 51 is driven synchroneously with the conveyeor belt 17 (FIG. 3). This gear belt 51 is coupled with the slide 32 or decoupled therefrom by a clamping cylinder of a pneumatic clutch 52. This is necessary because the slide 32 is temporarily coupled through the electromagnetic clutch 45 with the slide 33, which then moves the slide 32.

The gear belt 51 is guided with the aid of a guide roller 53 at the free end 54 of the mechanism 47 (FIG. 1), and further runs over the guide rollers 55 and 56 which are mounted on the piston cylinder device 47 or which are elevationally adjustable together therewith. Further, the gear belt 51 is guided over the guide rollers 57 and 58 which are mounted on a carrier and guide device 59 (FIG. 1) for the mechanism 30 with the piston cylinder device 47.

Figure 8:
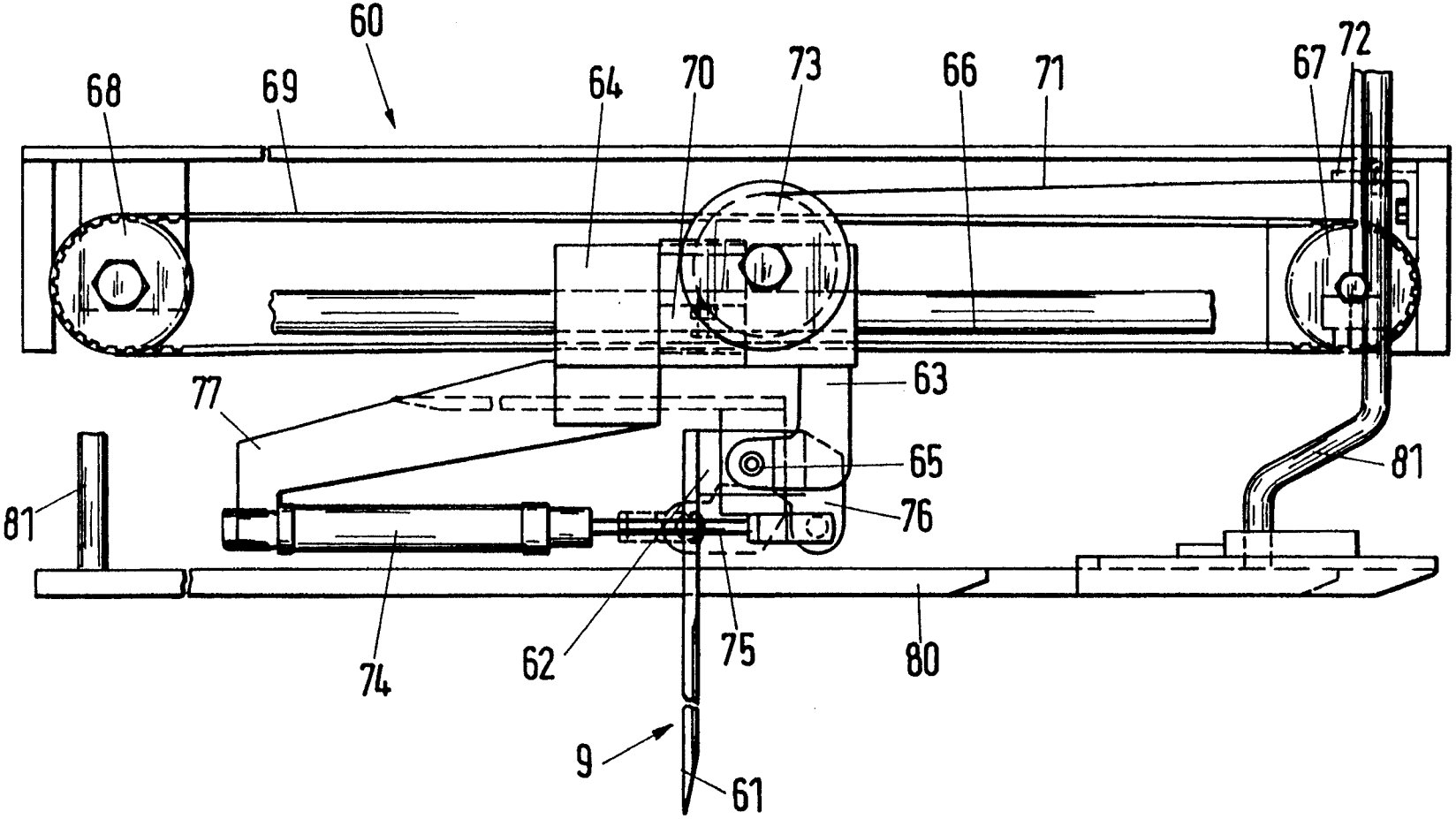
FIG. 8 shows, on an enlarged scale compared to FIG. 1, a side view of the mounting and of the drive of the second forward stack holder.
Figure 9:
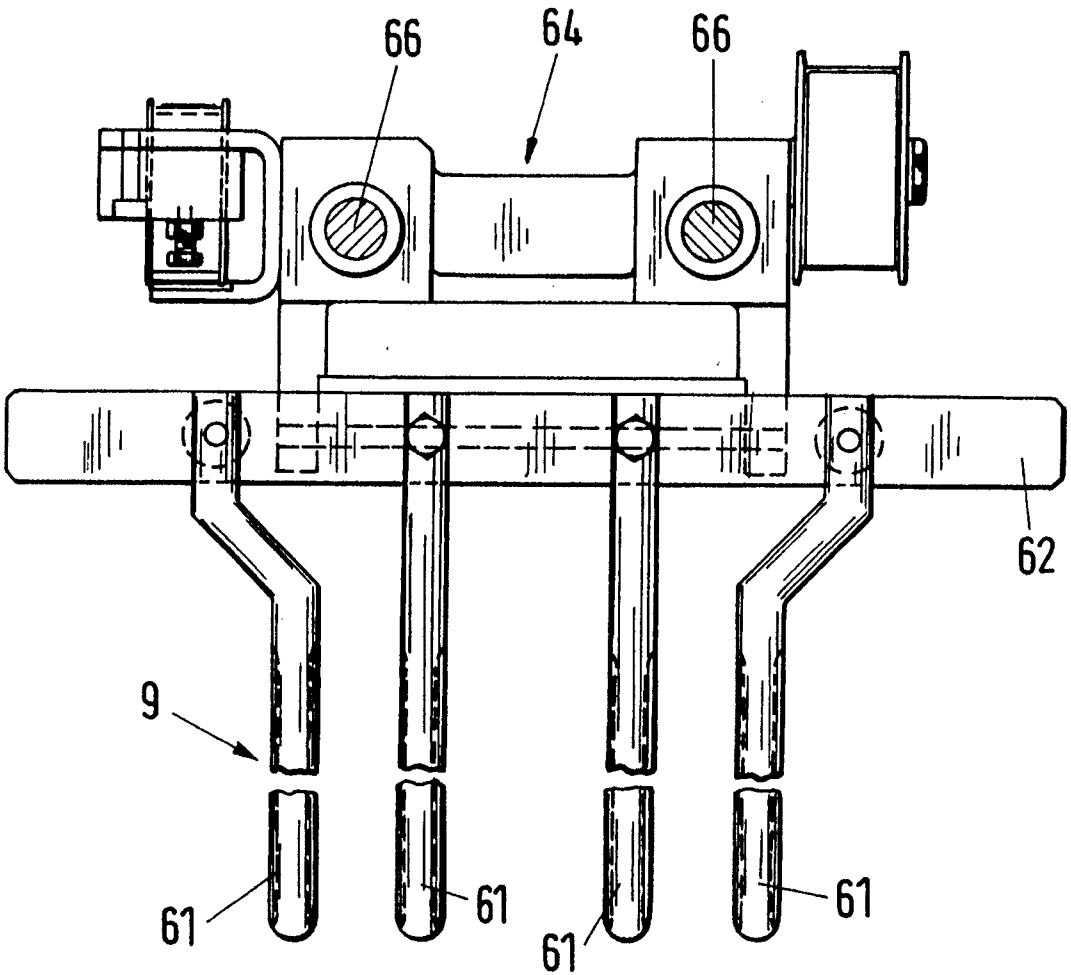
FIG. 9 shows details of the second forward stack holder.

For the tilting and horizontal movement of the second forward stack holder 9, which is tiltable from above into a position in front of the stack 10 being formed, there is provided a guide and holding mechanism 60, the essential details of which are shown in FIGS. 8 and 9.

The stack holder 9 comprises, just as the stack holder 12, several, preferably four elongated, finger-type elements 61 which are arranged on a carrier 62. The elements 61 and the carrier 62 are tiltably mounted on arms 63 of a slide 64 for tilting about an axis 65. The slide 64 is displaceable along guide rods 66 which are part of the guiding and holding mechanism 60.

A gear belt 69 is provided for driving the slide 64, one end of which runs around a drive wheel 67 and which is guided around a guide wheel 68. The gear belt 69 can be coupled or decoupled from the slide 64. For this purpose, again a pneumatic clutch 70 is provided which is only schematically indicated at the slide 64 in FIG. 8. The gear belt 69 is, in principle, driven in synchronism with the conveyor belt 17 so that a release from the gear belt 69 is necessary when the stack holder 9 or the slide 64 carrying the stack holder 9 are being moved back into the starting position according to FIGS. 4 and 5.

A roll up spring 71 is provided for pulling back the slide 64. The roll up spring 71 is connected with its one end 72 in the area of the drive wheel 67 to the guiding and holding mechanism 60 and is further guided around a roll up spring drum 73 which is mounted on the slide 64.

A tilting cylinder 74 serves for tilting the stack holder 9. A piston rod 75 of the cylinder 74 is pivoted to an arm 76 of the carrier 62. A second arm 77 serves as a carrier for the tilting cylinder 74 and connects the latter with the slide 64.

The guiding and holding mechanism 60 further comprises an upper stack guide element 80 (FIGS. 1, 8) which is carried by guide rods 81 that are vertically adjustable. The finger-type element 61 of the stack holder 9 reach through the stack guide element 80.

Figure 13:
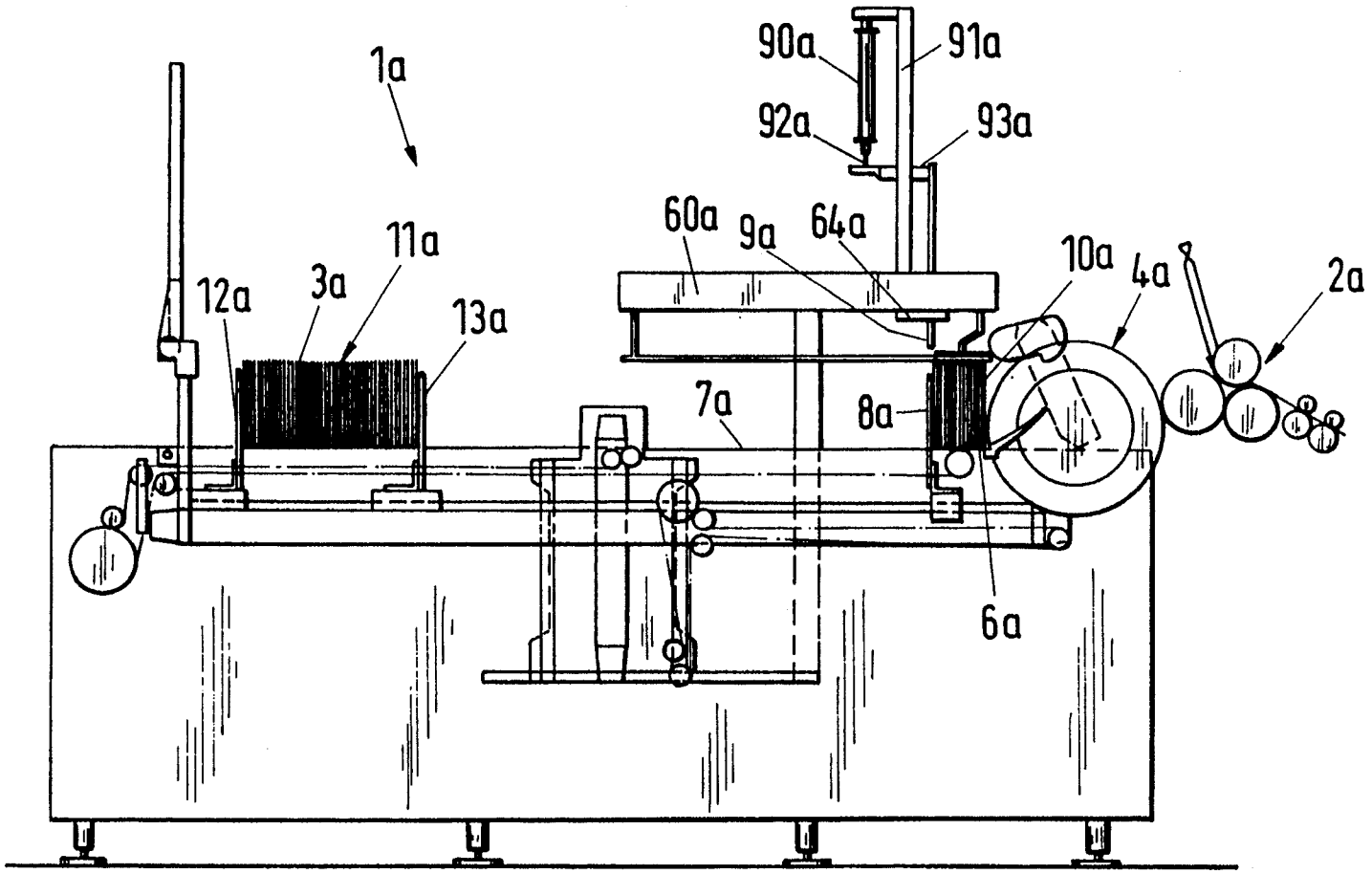
FIG. 13 is a view as in FIG. 5 of a modified embodiment.
Figure 14:
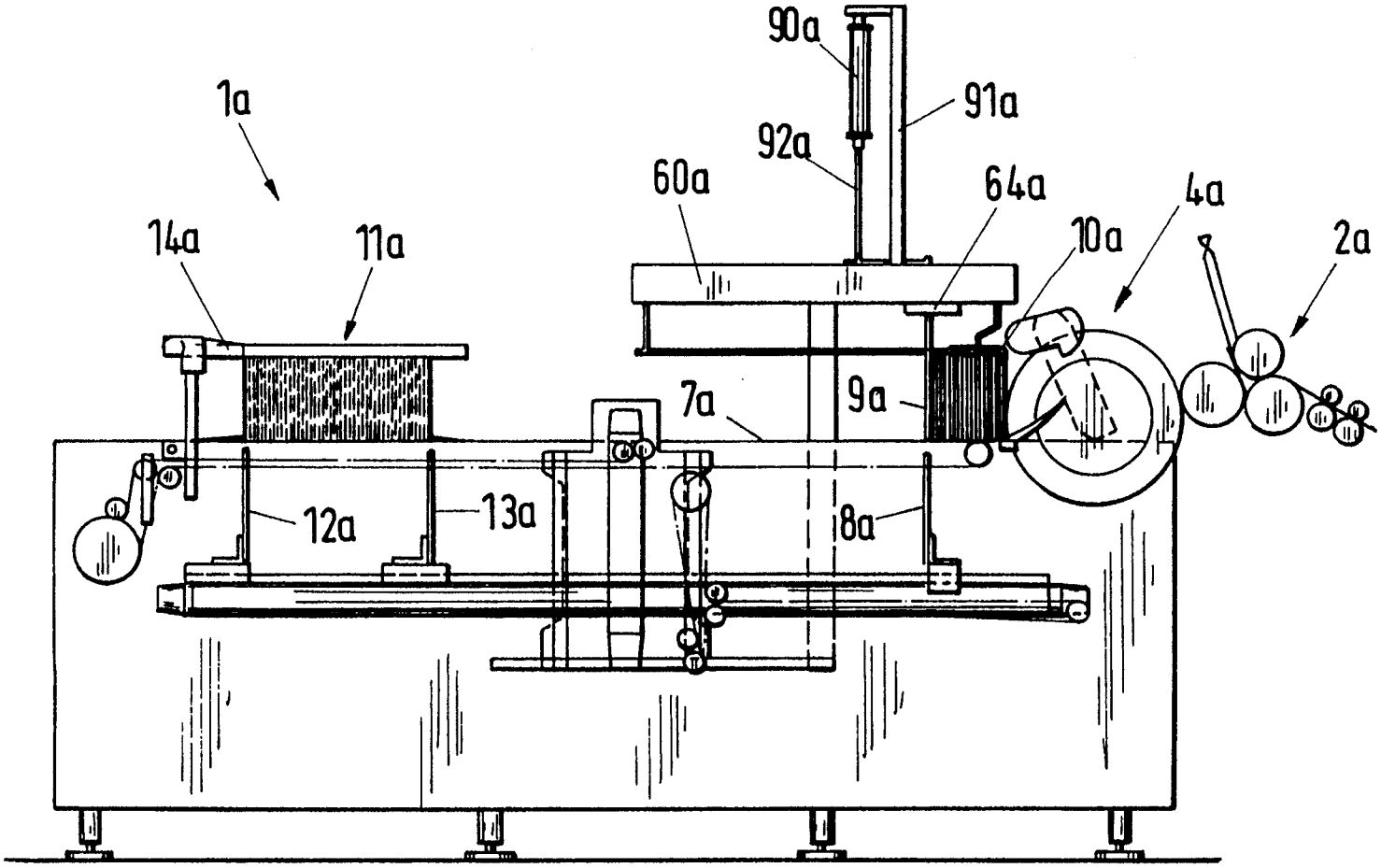
FIG. 14 is a view as in FIG. 6 of the embodiment according to FIG. 13.

FIGS. 13 and 14 show a modified apparatus 1*a*of the invention for stacking or rather forming, holding, separating, and transporting of stacks 10*a* or 11*a*, whereby the same reference numbers serve for designating the same components, however with the index a.

The apparatus 1*a* of FIGS. 13 and 14 differs from the stacking machine 1 described first, only in that the second stack holder 9*a* on a slide 64*a* is not tiltable, rather it is movable perpendicularly to the stacking surface 7*a*. The second forward stack holder 9*a* is mounted for movement in a vertical direction and it is further displaceable with the aid of the slide 64*a* parallel to the stack 10*a* as the latter grows in size.

The mounting and the drive for the slide 64*a* in the guiding and holding mechanism 60*a* may in principle be constructed exactly as described with reference to the first example embodiment. A difference thus exists only as far as the slide 64*a* carries a stroke mechanism 90*a*, for example, in the form of a piston cylinder device by means of which the second forward stack holder 9*a* is lifted when necessary as is shown in FIG. 13 or is lowered as is shown in FIG. 14. The slide 64*a* comprises for this purpose, a carrier 91*a* extending upwardly. The piston cylinder device 90*a* is connected to the upper end of the carrier. An entraining dog 93*a* connects the free end of the piston rod 92*a* with the second forward stack holder 9*a*. Preferably, the piston rod is guided and supported in the slide 64*a*.

The function and operation of the guiding and holding mechanism 60*a* with the second forward stack holder 9*a* that is movable parallel and vertically relative to the stacking surface 7*a* does not differ from that of the first described example embodiment when cooperating with the first forward stack holder 8*a* and the two other stack holders 12*a* or 13*a*. As long as the stack holder 8*a* according to FIG. 13 holds the stack 10*a*, the stack holder 9*a* is in a lifted position. When the two stack holders 12*a* and 13 release the stack 11*a* and are lowered for this purpose, the stack holder 8*a* also releases the stack 10*a* newly being formed, because it is lowered together with the two other stack holders 12*a* and 13*a*. Simultaneously, the stack holder 9*a* takes over the function of holding the stack 10*a*. For this purpose, the piston cylinder device or stroke mechanism 90*a* shifts the stack holder 9*a* in front of the stack 10*a* as is shown in FIG. 14.

The three stack holders 8, 12, and 13 or 8*a*, 12*a* and 13*a* move in unison respectively in a vertical direction or perpendicularly to the stacking surface 7 or 7*a* and in the horizontal direction only partially in unison, namely when especially the two stack holders 8 and 13 or 8*a* and 13*a* are moving out of the waiting position according to FIG. 7 into the ready position according to FIG. 1 and then through the separation position according to FIG. 2 into the transport and take over position according to FIG. 3. During the subsequent motion sequences until the waiting position is reached, the stack holders 8, 12, and 13 or 8*a*, 12*a*, and 13*a* move substantially independently of one another.

Although the invention has been described with reference to specific example embodiments, it will be appreciated that it is intended to cover all modifications and equivalents within the scope of the appended claims.

It is claimed:

1. A method for forming, holding, separating, and transporting stacks (10, 10*a*; 11, 11*a*) of articles (3, 3*a*) downstream of a depositing mechanism (4, 4*a*) which deposits continuously and individually arriving articles with an article edge (6, 6*a*) on a stacking surface (7, 7*a*) to form said stacks, said transporting taking place in a transport direction (a) from said depositing mechanism to a packing station (14), said stack having several sides extending in parallel to said transport direction, said method comprising the following steps:

(a) first holding articles at the beginning of a stack formation by a first leading stack holder (8, 8*a*) which moves in said transport direction in which a stack size increases;

(b) second holding a partly formed stack by a second leading stack holder (9, 9*a*) which takes over said partly formed stack from said first leading stack holder (8, 8*a*) while said second leading stack holder (9, 9*a*) is also moving in said transport direction;

(c) engaging a leading end of a completed stack (11, 11*a*) by a third leading stack holder (12, 12*a*) and engaging a rear end of said completed stack by a rear fourth stack holder (13, 13*a*) for further transporting said completed stack (11, 11*a*) in said transport direction (a) toward said packing station (14);

(d) simultaneously with said engaging of the completed stack (11, 11*a*) by said third leading stack holder (12, 12*a*) and by said rear fourth stack holder (13, 13*a*), separating said completed stack (11, 11*a*) from a next stack (10) being formed, by entering said first leading stack holder (8, 8*a*) and said rear fourth stack holder (13, 13*a*) between said completed stack (11, 11*a*) and said next stack (10, 10*a*);

(e) supporting said next stack by said first leading stack holder (8, 8*a*) and by said rear fourth stack holder (13, 13*a*);

(f) moving any three stack holders (8, 8*a*; 12, 12*a*; 13, 13*a*) of said four stack holders crosswise to said transport direction (a) from one stack side of said several sides of said stack and also moving said any three stack holders alongside said transport direction for said transporting of a stack; and (g) moving any one stack holder (9, 9*a*) of said four stack holders crosswise to said transport direction from another stack side and also moving said any one stack holder (9, 9*a*) temporarily in said transport direction and then opposite said transport direction back to a starting position.

2. The method of claim 1, wherein any two of said three leading stack holders and said rear stack holder form said any three stack holders for performing said moving of said step (f); and wherein said any one stack holder (9, 9*a*) is the third of said three stack holders for performing said moving of said step (g).

3. The method of claim 1, further comprising forming a transport unit of said rear stack holder (13, 13*a*) and of one (12, 12*a*) of said three leading stack holders, sequentially operating the other two leading stack holders (8, 8*a*; 9, 9*a*) for holding a next stack being formed until the next stack is complete, and then moving said transport unit (12, 12*a*; 13, 13*a*) to take over a completed stack and to bring said completed stack to said packing station (14).

4. An apparatus for forming, holding, separating and transporting stacks of articles (3, 3*a*) downstream of a depositing mechanism (4, 4*a*) which deposits continuously and individually arriving articles with an article edge, comprising a stacking surface (7, 7*a*) leading in a transport direction from said depositing mechanism (4, 4*a*) to a packing station (14), said stacking surface forming a stacking level on which articles are deposited, said apparatus further comprising four movable stack holders for holding an article on said stacking surface, drive means connected to said four stack holders for operating said stack holders, said movable stack holders comprising three leading stack holders (8, 9, 12 or 8*a*, 9*a*, 12*a*) and one rear stack holder (13, 13*a*), said drive means comprising first drives adapted for moving said three leading stack holders crosswise of said transport direction (a) and in parallel to said transport direction, said drive means further comprising a second drive adapted for moving said rear stack holder (13, 13*a*) crosswise of said transport direction and in said transport direction for holding a stack during its formation and for transporting a completed stack, said first drives, two of said three leading stack holders (8, 8*a*; 12, 12*a*), and said rear stack holder (13, 13*a*) being arranged for moving said two leading stack holders and said rear stack holder from one and the same side of a stack crosswise to said transport direction and in parallel to said transport direction, and wherein said second drive and the third of said three leading stack holders are arranged for moving from another side of a stack crosswise to said transport direction and in parallel to said transport direction, whereby a stack is positively held and guided during its formation and during its transportation.

5. The apparatus of claim 4, wherein three of said four stack holders (8, 12 and 13 or 8*a*, 12*a* and 13*a*) are mounted below said stacking surface (7, 7*a*), and wherein one stack holder (9, 9*a*) of said four stack holders is mounted above a stack (10, 11 or 10*a*, 11*a*).

6. The apparatus of claim 5, wherein said one stack holder (9) mounted above the stack (10, 11) is supported in a tiltable manner crosswise to said transport direction and in a slidable manner in said transport direction.

7. The apparatus of claim 5, wherein said three stack holders (8, 12 and 13 or 8*a*, 12*a* and 13*a*) mounted below said stacking surface are mounted on slides (32, 33, 34) movable in said transport direction, said first drive comprising a stroke mechanism (31) for moving said three stack holders in unison crosswise to said transport direction.

8. The apparatus of claim 4, wherein one stack holder (9, 9*a*) of said three leading stack holders is tiltable from above into a position in front of a stack being formed, said tilting being directed toward another leading stack holder (8, 8*a*) that is movable from below said stacking surface in front of the stack (10, 10*a*), said one stack holder being also movable during a stack formation alongside said transport direction, said one stack holder (9, 9*a*) being further tiltable upwardly and then movable opposite said transport direction toward said depositing mechanism (4, 4*a*).

9. The apparatus of claim 4, wherein one stack holder (9*a*) of said three leading stack holders is movable parallel and vertically relative to said stacking surface (7*a*).

10. The apparatus of claim 4, wherein said first leading stack holder (8) and said rear stack holder (13) are movable into and out of a travel path of a stack in synchronism with each other.

* * * * *